US011793377B2

(12) United States Patent
Tahara et al.

(10) Patent No.: US 11,793,377 B2
(45) Date of Patent: Oct. 24, 2023

(54) BACKPACK DUST COLLECTOR

(71) Applicant: MAKITA CORPORATION, Anjo (JP)

(72) Inventors: Takayuki Tahara, Anjo (JP); Makoto Hotta, Anjo (JP)

(73) Assignee: MAKITA CORPORATION, Anjo (JP)

( * ) Notice: Subject to any disclaimer, the term of this patent is extended or adjusted under 35 U.S.C. 154(b) by 336 days.

(21) Appl. No.: 16/783,312

(22) Filed: Feb. 6, 2020

(65) Prior Publication Data

US 2020/0281424 A1 Sep. 10, 2020

(30) Foreign Application Priority Data

Mar. 5, 2019 (JP) ..... 2019-039485

(51) Int. Cl.

| | |
|---|---|
| ***A47L 5/36*** | (2006.01) |
| ***A47L 9/28*** | (2006.01) |
| ***A47L 9/10*** | (2006.01) |

(52) U.S. Cl.

CPC ..... *A47L 5/36* (2013.01); *A47L 9/102* (2013.01); *A47L 9/2821* (2013.01)

(58) Field of Classification Search

CPC ... A47L 5/36; A47L 5/22; A47L 5/365; A47L 9/102; A47L 9/2821; A47L 9/0072; A47L 9/122; A47L 9/14; A47L 9/2831; A47L 9/2884; A47L 9/00; A47L 9/0081; A47L 9/1418; A47L 9/22; A47L 9/24; A47L 7/009

See application file for complete search history.

(56) References Cited

U.S. PATENT DOCUMENTS 2,520,531 A * 8/1950 Cuddeback ..... A47L 9/20 55/305
2,714,426 A * 8/1955 White ..... A47L 5/365 55/366
4,944,065 A 7/1990 Svanberg et al.
5,681,363 A 10/1997 Tucker et al.
(Continued)

FOREIGN PATENT DOCUMENTS

CN 1689501 A 4/2005
CN 1778247 A 5/2006
(Continued)

OTHER PUBLICATIONS

Jan. 26, 2022 Office Action issued in Chinese Patent Application No. 202010020377.9.
(Continued)

*Primary Examiner* — Eric J Rosen
*Assistant Examiner* — Christopher Soto
(74) *Attorney, Agent, or Firm* — Oliff PLC

(57) ABSTRACT

A backpack dust collector includes a housing and a filter. The housing includes a suction port, a dust collecting chamber connected to the suction port and accommodating a dust collecting bag, a motor chamber connected to the dust collecting chamber and accommodating a fan and a motor, and an exhaust port through which air from the motor chamber is discharged. The filter is disposed on a side of the dust collecting chamber so as to face the dust collecting chamber.

19 Claims, 15 Drawing Sheets

(56) References Cited

U.S. PATENT DOCUMENTS

| | | | | |
|---|---|---|---|---|
| 5,704,956 | A * | 1/1998 | Loveless | B01D 46/76 55/482 |
| 6,151,749 | A * | 11/2000 | Berfield | |
| 6,295,692 | B1 * | 10/2001 | Shideler | A47L 9/22 15/327.5 |
| 9,259,126 | B2 * | 2/2016 | Niederman | A47L 9/22 |
| 9,282,860 | B2 * | 3/2016 | Brison | |
| 2004/0226129 | A1 | 11/2004 | Nakamoto et al. | |
| 2005/0076624 | A1 | 4/2005 | Cho | |
| 2006/0005346 | A1 * | 1/2006 | Rupp | A47L 5/36 15/327.5 |
| 2006/0107628 | A1 | 5/2006 | Yoshida et al. | |
| 2006/0283158 | A1 * | 12/2006 | Kennedy | A47L 9/20 55/300 |
| 2014/0096339 | A1 | 4/2014 | Niederman | |
| 2014/0143977 | A1 * | 5/2014 | Wofford | A47L 9/122 29/428 |
| 2017/0007085 | A1 | 1/2017 | Tahara | |
| 2018/0266440 | A1 | 9/2018 | Shiozawa | |
| 2019/0000287 | A1 | 1/2019 | Duong et al. | |
| 2019/0313864 | A1 | 10/2019 | Tahara | |

FOREIGN PATENT DOCUMENTS

| | | | |
|---|---|---|---|
| CN | 1923111 | A | 3/2007 |
| CN | 1951300 | A | 4/2007 |
| CN | 102028434 | A | 4/2011 |
| CN | 102188192 | A | 9/2011 |
| CN | 103068290 | A | 4/2013 |
| CN | 106333628 | A | 1/2017 |
| DE | 91 04 953 | U1 | 6/1991 |
| DE | 689 14 568 | T2 | 9/1994 |
| EP | 1 776 912 | A2 | 4/2007 |
| EP | 2 601 876 | A1 | 6/2013 |
| JP | H11-0099110 | A | 4/1999 |
| JP | 2006-020829 | A | 1/2006 |
| JP | 2006-305248 | A | 11/2006 |
| JP | 2017-018567 | A | 1/2017 |
| JP | 2018-155237 | A | 10/2018 |

OTHER PUBLICATIONS

May 24, 2022 Office Action issued in Chinese Patent Application No. 202010020377.9.

Aug. 16, 2022 Office Action issued in Japanese Patent Application No. 2019-039485.

Aug. 29, 2022 Office Action issued in Chinese Patent Application No. 202010020377.9.

Mar. 7, 2023 Office Action issued in German Patent Application No. 10 2023 1135 658.3.

* cited by examiner

BACKPACK DUST COLLECTOR

CROSS-REFERENCE TO RELATED APPLICATION(S)

The present application claims priority to and incorporates by reference the entire contents of Japanese Patent Application No. 2019-039485 filed in Japan on Mar. 5, 2019.

BACKGROUND OF THE INVENTION

1. Field of the Invention

The present invention relates to a backpack dust collector.

2. Description of the Related Art

A backpack dust collector includes a fan and a motor configured to generate motive power for rotating the fan. By rotating the fan, air is suctioned with dust through a suction port of the backpack dust collector. The air suctioned through the suction port flows through an internal space of the backpack dust collector, and is then discharged through an exhaust port. An example of related art is described in JP-A-2017-018567.

The dust suctioned through the suction port is caught and collected by a dust collecting bag accommodated in a dust collecting chamber of the backpack dust collector. Fine dust that cannot be caught by the dust collecting bag is caught and collected by a filter disposed in the dust collecting chamber. When the filter has been clogged, suction force of the dust collector may be reduced.

An object of an aspect of the present invention is to suppress reduction of suction force.

SUMMARY OF THE INVENTION

According to an aspect of the present invention, a backpack dust collector includes a housing and a filter. The housing includes a suction port, a dust collecting chamber connected to the suction port and accommodating a dust collecting bag, a motor chamber connected to the dust collecting chamber and accommodating a fan and a motor, and an exhaust port through which air from the motor chamber is discharged. The filter is disposed on a side of the dust collecting chamber so as to face the dust collecting chamber.

DETAILED DESCRIPTION OF THE PREFERRED EMBODIMENTS

Embodiments of the present invention will now be described with reference to the drawings. However, the present invention is not limited to these embodiments. Components according to the respective embodiments may be combined appropriately. Some components may be omitted.

In the following description, the terms "left", "right", "front", "rear", "up", and "down" are used to describe positional relations of the respective components. These terms indicate relative positions or directions with respect to an operator WM.

First Embodiment

Figure 1:
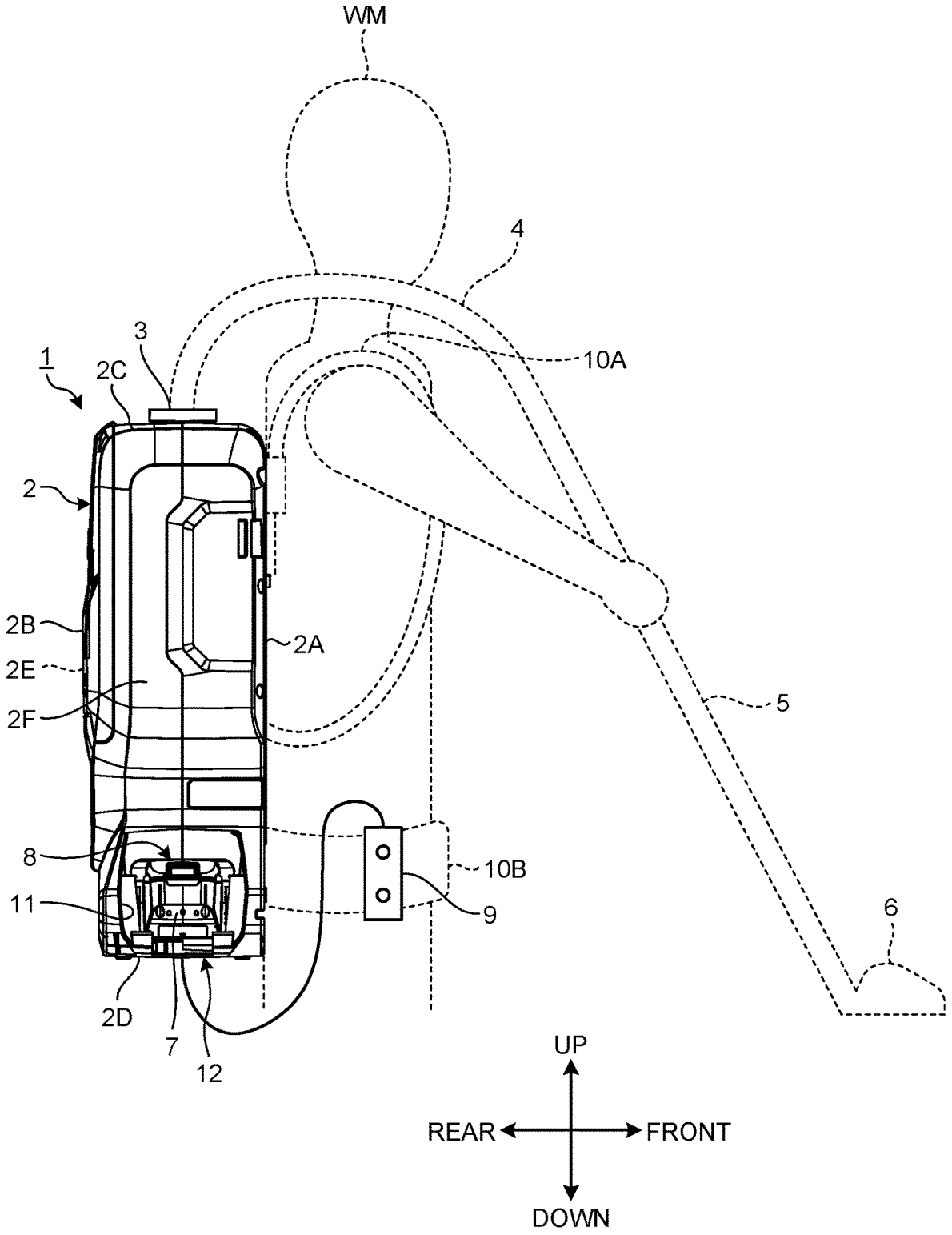
FIG. 1 is a side view of a backpack dust collector according to a first embodiment.

FIG. 1 is a side view of a backpack dust collector 1 according to the present embodiment. As illustrated in FIG. 1, the backpack dust collector 1 is used while being carried on an operator WM's back. The backpack dust collector 1 includes a housing 2, a hose 4 connected to a suction port 3 of the housing 2, a pipe 5 connected to the hose 4, a nozzle 6 connected to the pipe 5, one or more battery mounting portions 8 on each of which a general-purpose battery 7 is mounted, and an operation unit 9.

The general-purpose battery 7 can be used as a power supply for electrical machinery and apparatus of various types. The general-purpose battery 7 can be used as a power supply for a power tool. The general-purpose battery 7 can be used also as a power supply for electric machinery and apparatus other than the power tool. The general-purpose battery 7 can be used also as a power supply for a dust collector other than the backpack dust collector 1 according to the present embodiment. In the following description, the general-purpose battery 7 is called "battery 7" as appropriate.

The housing 2 is carried on the operator WM's back. The housing 2 is attached to the operator WM's back with shoulder belts 10A and a waist belt 10B. The shoulder belts 10A are attached to the operator WM's shoulders. The waist belt 10B is attached to the operator WM's waist.

The housing 2 has an internal space. The housing 2 has a front surface 2A facing forward, a rear surface 2B facing rearward, an upper surface 2C facing upward, a lower surface 2D facing downward, a left side surface 2E facing leftward, and a right side surface 2F facing rightward. In a state in which the housing 2 is carried on the operator WM's back, the front surface 2A of the housing 2 faces the operator WM's back.

The suction port 3 is disposed in an upper portion of the housing 2. The hose 4 is flexible. One end portion of the hose 4 is connected to the suction port 3. The other end portion of the hose 4 is connected to one end portion of the pipe 5. The nozzle 6 is connected to the other end portion of the pipe 5. The nozzle 6 has a suction opening.

The housing 2 has one or more battery openings 11 through which the corresponding batteries 7 can pass and one or more battery receiving portions 12 connected to the corresponding battery openings 11. Each battery 7 is received by the corresponding battery receiving portion 12. Each battery opening 11 is disposed in a lower portion of the housing 2. Each battery mounting portion 8 is arranged in the corresponding battery receiving portion 12.

The operation unit 9 is operated by the operator WM. The operation unit 9 includes a switch for starting up the backpack dust collector 1. The operation unit 9 is attachable to the waist belt 10B.

Figure 2:
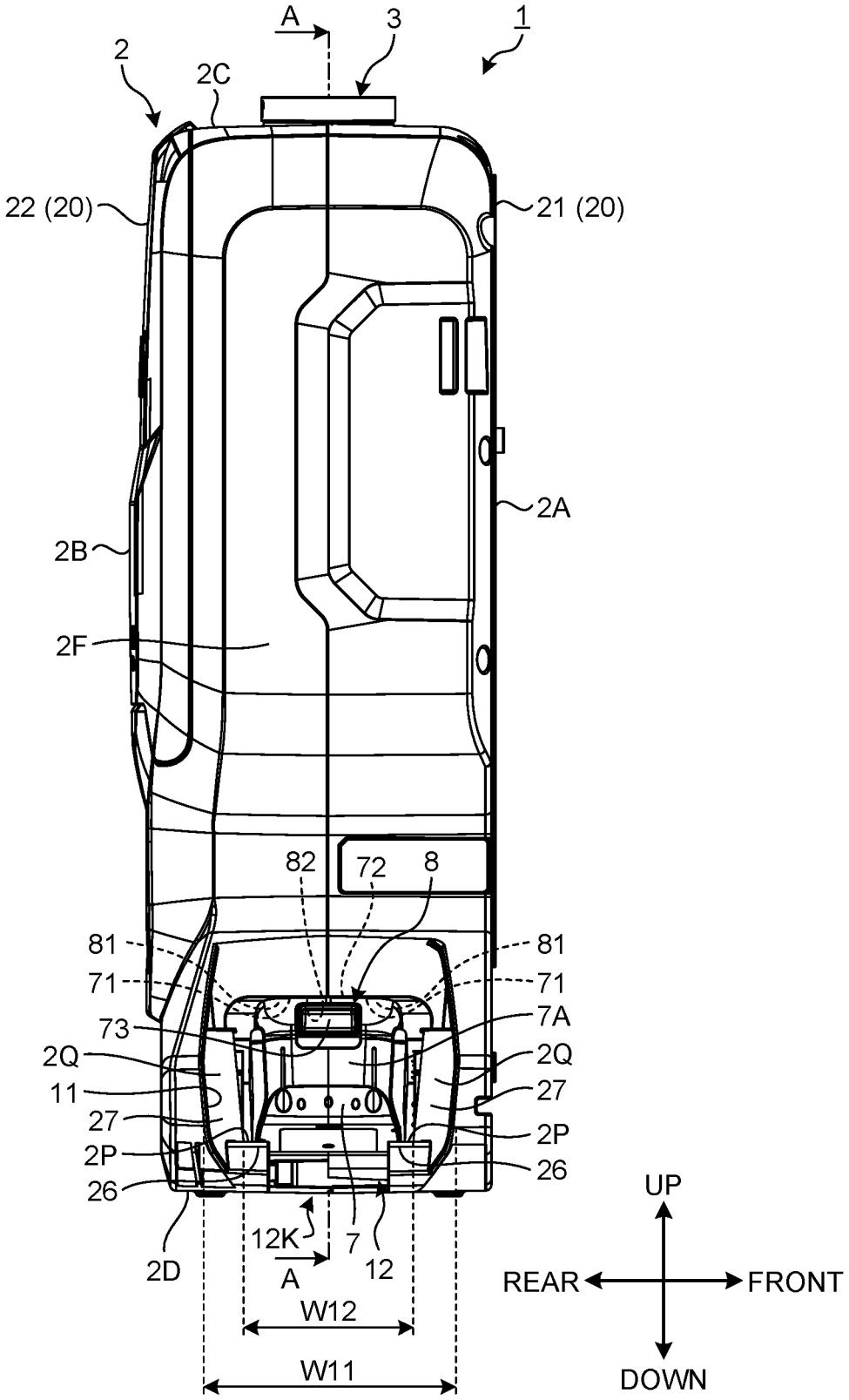
FIG. 2 is a side view of the backpack dust collector according to the first embodiment.
Figure 3:
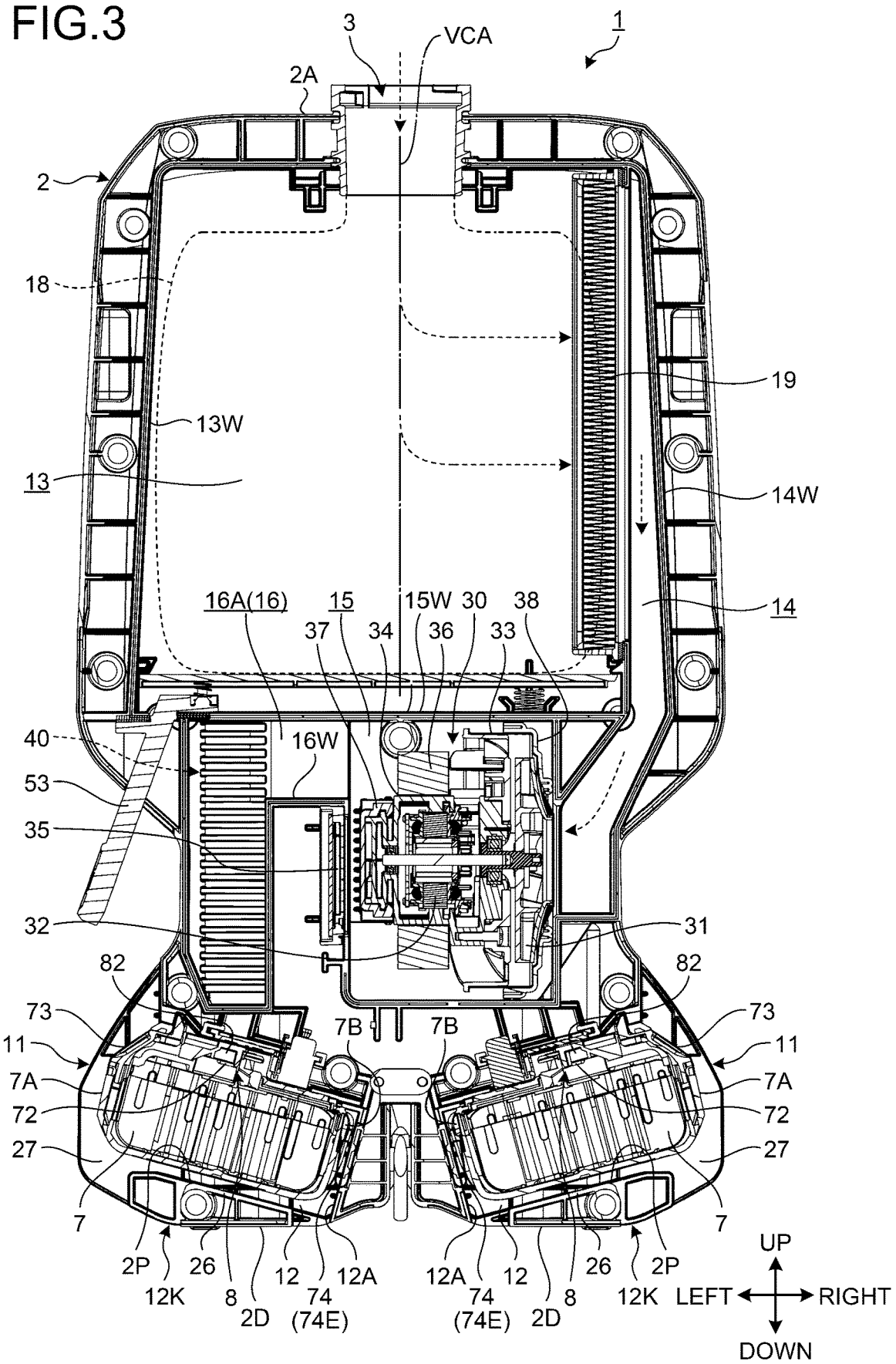
FIG. 3 is a sectional view of the backpack dust collector according to the first embodiment.
Figure 4:
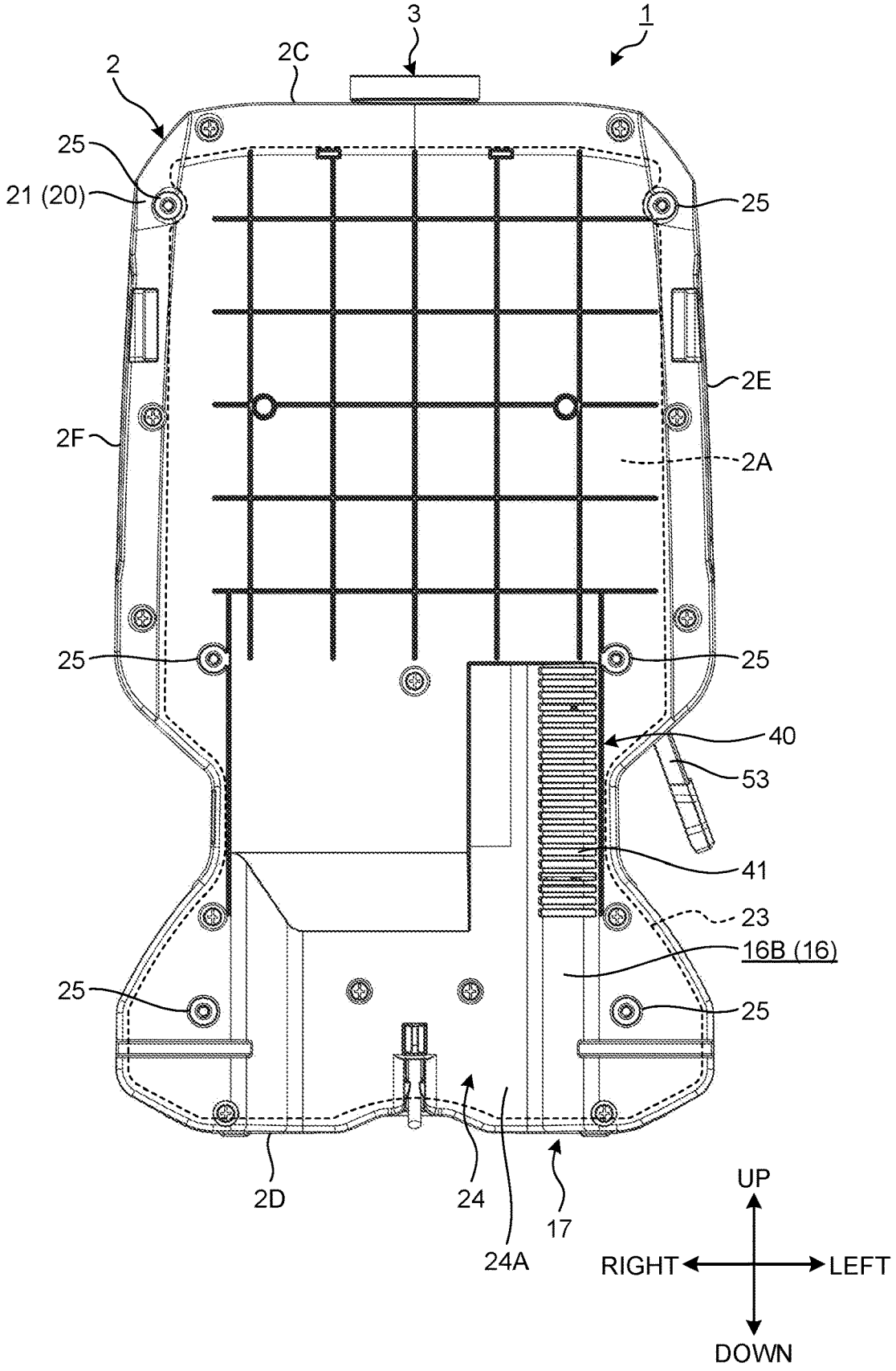
FIG. 4 is a front view of the backpack dust collector according to the first embodiment.
Figure 5:
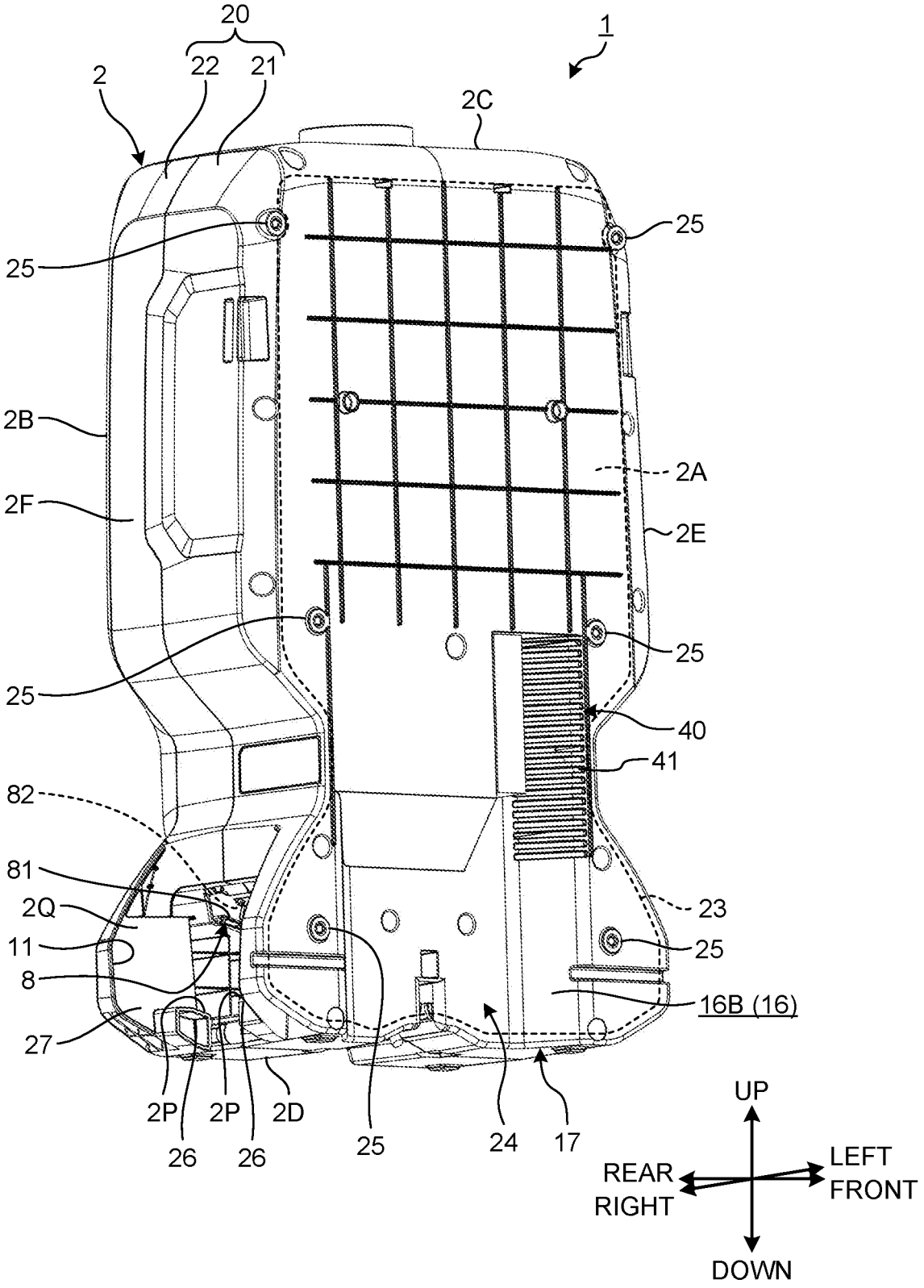
FIG. 5 is a perspective view of the backpack dust collector according to the first embodiment.

FIG. 2 is a side view of the backpack dust collector 1 according to the present embodiment. FIG. 3 is a sectional view of the backpack dust collector 1 according to the present embodiment taken along line A-A in FIG. 2. FIG. 4 is a front view of the backpack dust collector 1 according to the present embodiment. FIG. 5 is a perspective view of the backpack dust collector 1 according to the present embodiment.

The housing 2 includes a base housing 20 having an internal space and a plate 23 connected to the base housing 20. The base housing 20 includes a front housing 21 and a rear housing 22. The front housing 21 and the rear housing 22 are connected to each other. The plate 23 is connected to the front housing 21. The plate 23 is fixed to the front housing 21 with a plurality of threaded bosses 25. In FIG. 4 and FIG. 5, the plate 23 is indicated by an imaginary line.

The front housing 21 includes part of the upper surface 2C, part of the lower surface 2D, part of the left side surface 2E, and part of the right side surface 2F. The rear housing 22 includes the rear surface 2B, part of the upper surface 2C, part of the lower surface 2D, part of the left side surface 2E, and part of the right side surface 2F. A rear end portion of the front housing 21 and a front end portion of the rear housing 22 are connected to each other, whereby the internal space of the base housing 20 is defined.

The front housing 21 has a recessed portion 24 formed therein. The recessed portion 24 is recessed rearward in a lower portion of the front housing 21. The plate 23 is disposed so as to cover the opening of the recessed portion 24. The plate 23 includes the front surface 2A. In a state in which the housing 2 is carried on the operator WM's back, the plate 23 faces the operator WM's back.

The housing 2 includes the suction port 3, a dust collecting chamber 13 connected to the suction port 3, a motor chamber 15 connected to the dust collecting chamber 13 with a flow path 14 interposed therebetween, and an exhaust port 17 connected to the motor chamber 15 with a flow path 16 interposed therebetween.

The dust collecting chamber 13, the flow path 14, the motor chamber 15, and part of flow path 16 are defined as the internal space of the base housing 20. Part of the flow path 16 is defined between the recessed portion 24 of the front housing 21 and the plate 23.

The dust collecting chamber 13 is disposed in an upper portion of the internal space of the base housing 20 and has a vertical central axis VCA that is a vertical longitudinal axis at a center of the dust collecting chamber 13. The dust collecting chamber 13 is defined by a partition wall 13W arranged in at least part of the perimeter of the dust collecting chamber 13. The dust collecting chamber 13 accommodates a dust collecting bag 18. The dust collecting bag 18 is connected to the suction port 3. The dust collecting bag 18 is a paper bag, for example. The dust collecting bag 18 is configured to catch and collect dust.

The motor chamber 15 is disposed below the dust collecting chamber 13 in the internal space of the base housing 20. The motor chamber 15 is defined by a partition wall 15W arranged in at least part of the perimeter of the motor chamber 15. The motor chamber 15 accommodates a drive unit 30 including a fan 31 and a motor 32.

The flow path 14 is disposed in a right portion of the internal space of the base housing 20. The flow path 14 is defined by a partition wall 14W arranged in at least part of the perimeter of the flow path 14. The flow path 14 extends in an up-and-down direction. The flow path 14 connects a right portion of the dust collecting chamber 13 and a right portion of the motor chamber 15.

In a boundary between the dust collecting chamber 13 and the flow path 14, a filter 19 is disposed. The filter 19 is a high-efficiency particulate air filter (HEPA), for example. An entirety of the filter 19 is disposed on a side of the vertical central axis VCA of the dust collecting chamber 13. In the present embodiment, the filter 19 is disposed on the right side of the dust collecting chamber 13. The filter 19 extends in the up-and-down direction. The filter 19 is disposed so as to face the dust collecting chamber 13.

The flow path 16 connects the motor chamber 15 and the exhaust port 17. Air from the motor chamber 15 is discharged to a space outside the housing 2 through the exhaust port 17.

Figure 6:
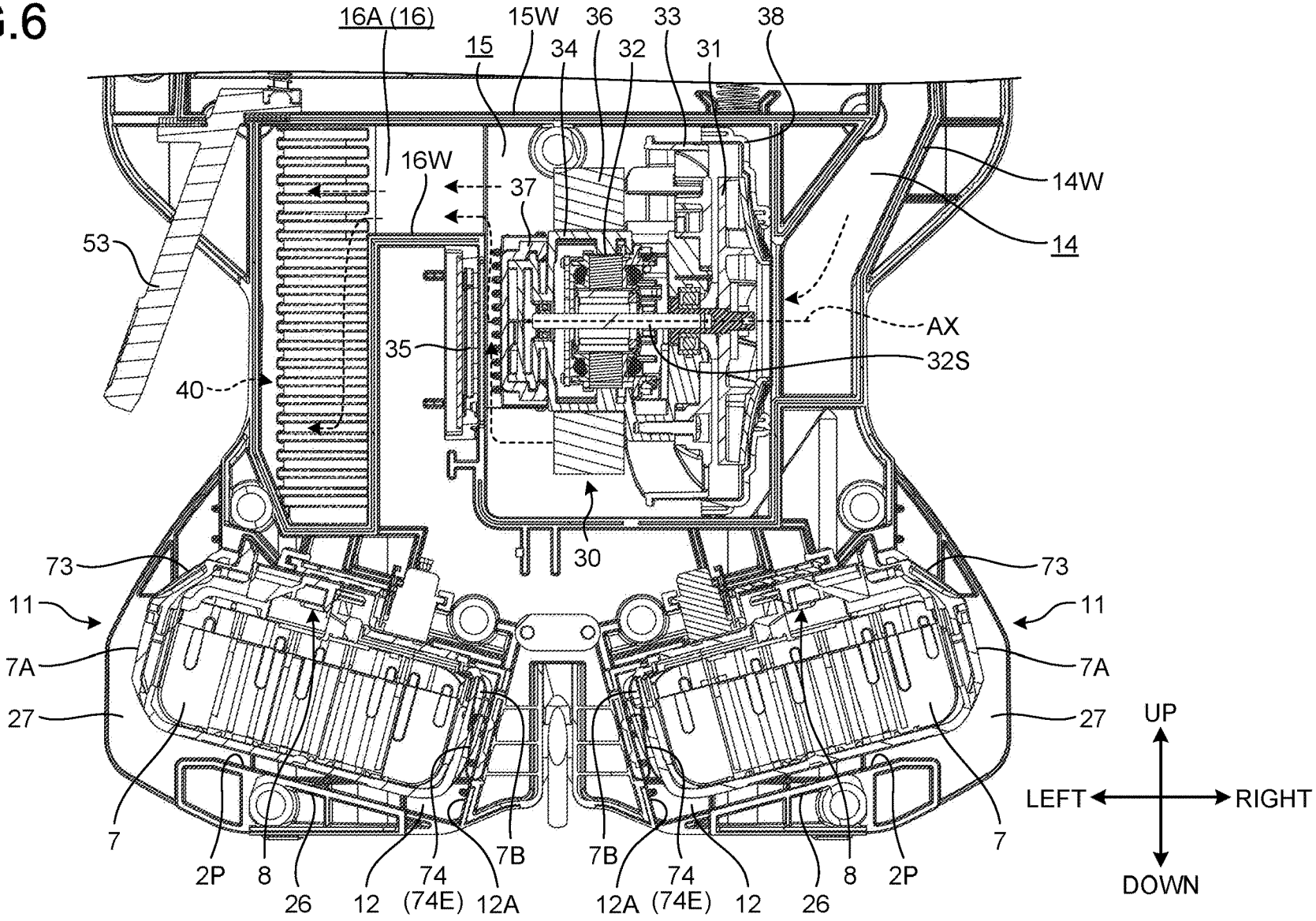
FIG. 6 is a sectional view of the vicinity of a drive unit according to the first embodiment.

FIG. 6 is a sectional view of the vicinity of the drive unit 30 according to the present embodiment. As illustrated in FIG. 6, the drive unit 30 includes the fan 31, the motor 32 configured to generate motive power for rotating the fan 31, a fan cover 33 accommodating the fan 31, a motor case 34 supporting the motor 32, a damper 36 disposed around the motor case 34, a motor support 37 supporting the motor case 34, and a support ring 38 disposed around the fan cover 33. The drive unit 30 is accommodated in the motor chamber 15.

The fan 31 is rotatable about a rotation axis AX. The fan 31 is disposed in the motor chamber 15 below the dust collecting chamber 13 such that the rotation axis AX is orthogonal to the up-and-down direction. The rotation axis AX of the fan 31 extends in a right-and-left direction. An output shaft 32S of the motor 32 is coupled to the fan 31. The rotation axis of the motor 32 corresponds to the rotation axis AX of the fan 31. By driving the motor 32, the fan 31 is rotated about the rotation axis AX.

The motor case 34 is disposed around the motor 32. The damper 36 absorbs noise generated by the motor 32. In other words, the damper 36 has a noise-absorbing function. Examples of the damper 36 include a sponge.

The motor support 37 and the support ring 38 each are an elastic member like rubber. The motor case 34 is fixed to the housing 2 with the motor support 37 and the support ring 38 interposed therebetween.

The backpack dust collector 1 includes a control board 35 disposed in the motor chamber 15. In the present embodiment, the control board 35 serves as a partition wall that defines the motor chamber 15. The control board 35 is disposed on the left side of the motor 32. The control board 35 is disposed downstream of the motor 32 such that a surface of the control board 35 is orthogonal to the rotation axis AX of the fan 31.

Figure 7:
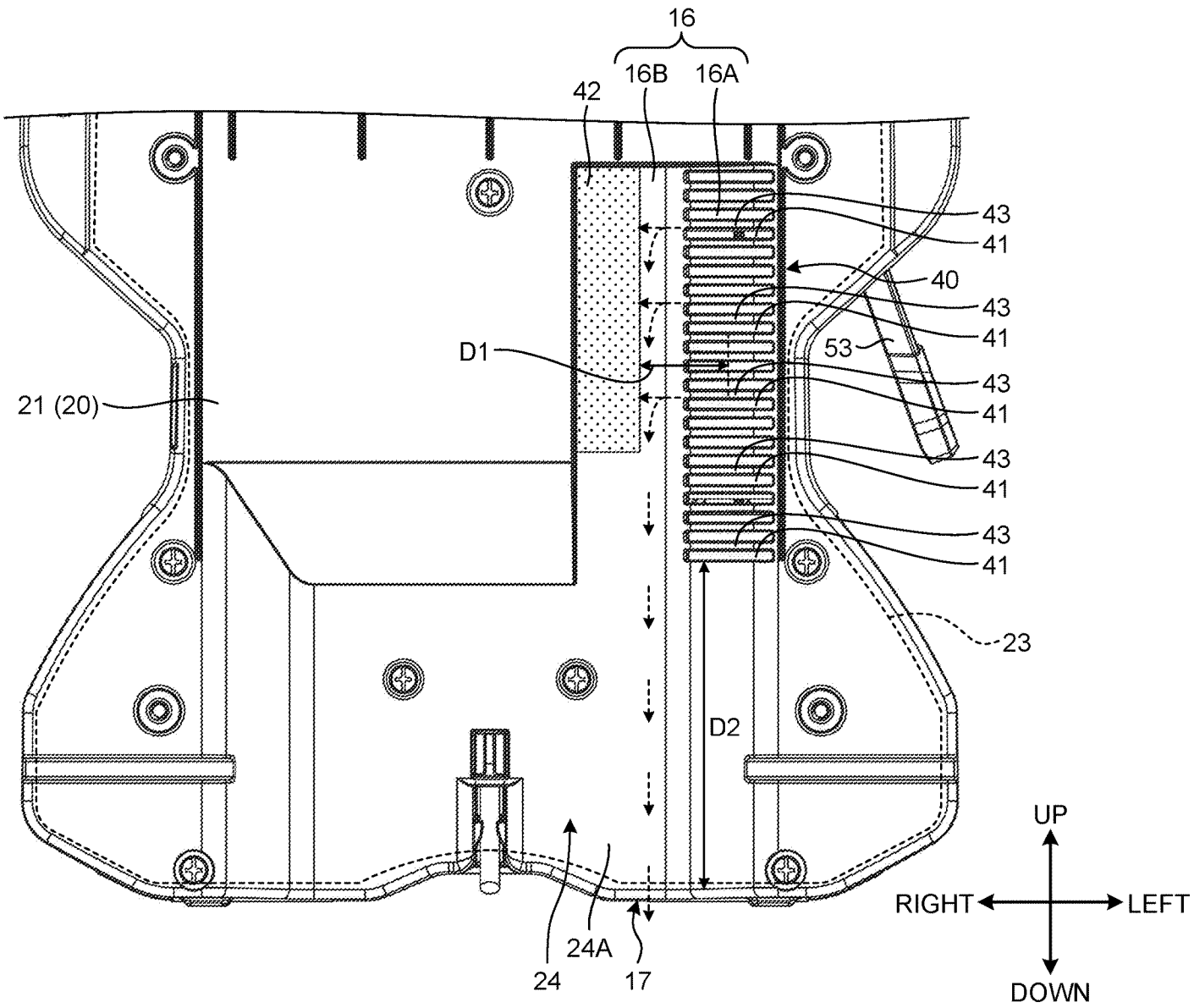
FIG. 7 is a diagram illustrating the vicinity of an exhaust port according to the first embodiment.
Figure 8:
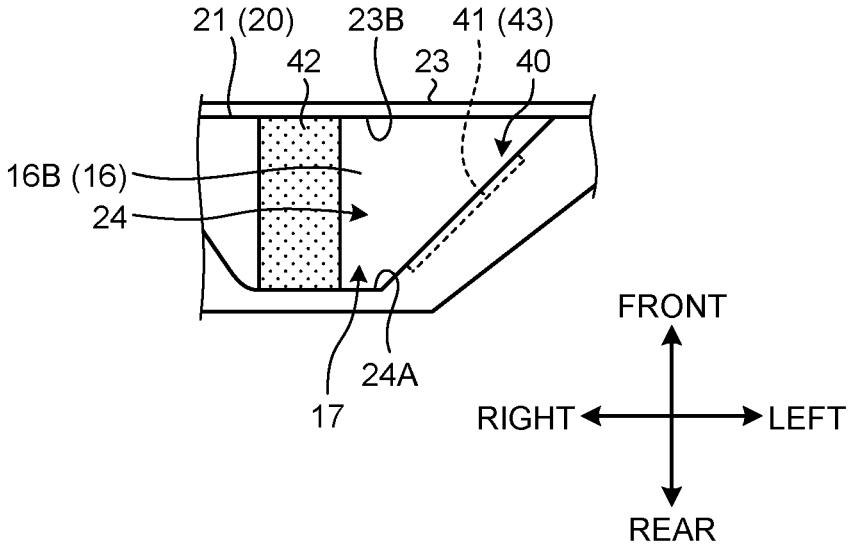
FIG. 8 is a diagram illustrating the exhaust port according to the first embodiment when viewed from below.

FIG. 7 is a diagram illustrating the vicinity of the exhaust port 17 according to the present embodiment. FIG. 8 is a diagram illustrating the exhaust port 17 according to the present embodiment when viewed from below. In FIG. 7, the plate 23 is indicated by an imaginary line.

The backpack dust collector 1 includes a slit portion 40 disposed in the flow path 16 between the motor chamber 15 and the exhaust port 17 and having slit-shaped vents 41 through which air from the motor chamber 15 passes.

The slit portion 40 is provided to at least part of the housing 2. In the present embodiment, the slit portion 40 is provided to the front housing 21. That is, the vents 41 are disposed in part of the front housing 21.

The vent 41 is narrow and long in the right-and-left direction. The longitudinal direction of the vent 41 corresponds to the right-and-left direction, and the crosswise direction of the vent 41 corresponds to the up-and-down direction. The vents 41 are arranged in the up-and-down direction. Between the vents 41 adjacent to each other, a rib 43 is provided.

The slit portion 40 is disposed in the flow path 16 between the motor chamber 15 and the exhaust port 17. The ribs 43 of the slit portion 40 divide the flow path 16 into a flow path 16A near the motor chamber 15 and a flow path 16B near the exhaust port 17. The flow path 16A between the motor chamber 15 and the slit portion 40 is defined in the internal space of the base housing 20. As illustrated in FIG. 3 and FIG. 6, the flow path 16A is defined by a partition wall 16W arranged in at least part of the perimeter of the flow path 16A. The flow path 16B between the slit portion 40 and the exhaust port 17 is defined between the recessed portion 24 of the front housing 21 and the plate 23.

The dimension of each vent 41 in the crosswise direction is small. The dimension of the vent 41 in the crosswise direction is so small that foreign matters in a space outside the housing 2 are prevented from entering the internal space (flow path 16A) of the housing 2.

The flow path 16B extends in the up-and-down direction. The flow path 16B is defined between an inner surface 24A of the recessed portion 24 of the front housing 21 and a rear surface 23B of the plate 23. The exhaust port 17 is defined in a lower end portion of the flow path 16B. In other words, the exhaust port 17 is defined by a lower end portion of the inner surface 24A of the recessed portion 24 and a lower end portion of the rear surface 23B of the plate 23.

In a state in which the housing 2 is carried on the operator WM's back, the vents 41 face laterally. In the present embodiment, the vents 41 face rightward. In the state in which the housing 2 is carried on the operator WM's back, the exhaust port 17 faces downward.

The backpack dust collector 1 includes a noise-absorbing member 42 disposed in at least part of the flow path 16B between the vents 41 and the exhaust port 17.

As illustrated in FIG. 7 and FIG. 8, the noise-absorbing member 42 is disposed so as to face the vents 41. The noise-absorbing member 42 faces each of the vents 41. At least part of the noise-absorbing member 42 is fixed to the inner surface 24A of the recessed portion 24. At least part of the noise-absorbing member 42 is fixed to the rear surface 23B of the plate 23.

The noise-absorbing member 42 includes a porous member. The noise-absorbing member 42 absorbs noise transmitted through air to suppress generation of noise. Examples of noise generated by the backpack dust collector 1 include wind noise generated when air passes through the vents 41 and NZ noise generated by rotation of the fan 31.

The noise-absorbing member 42 is an open-cell porous member. The noise-absorbing member 42 has numerous minute cells. The open cell means that the cells are connected to one another. As the open-cell porous member, at least one of soft urethane sponge, glass wool, rock wool, and felt is exemplified.

The open cell has a noise-absorbing function. Noise impinges on the cells at a surface of the noise-absorbing member 42. The noise impinging on the cells at the surface of the noise-absorbing member 42 propagates to adjacent cells. The noise strikes the inner surfaces of the cells. The cells are connected to one another. The noise propagates to other cells while reflecting off the inner surfaces of the cells. The energy of the noise is attenuated by striking the inner surfaces of the cells many times. Thus, the noise is reduced.

As illustrated in FIG. 7, the distance D1 between each vent 41 and the noise-absorbing member 42 is shorter than the distance D2 between the vent 41 and the exhaust port 17. The distance D2 is at least two times longer than the distance D1. The distance D1 is a distance between the center of the vent 41 in the longitudinal direction of the vent 41 and the noise-absorbing member 42.

The fan 31 rotates about the rotation axis AX, thereby generating suction force at the suction port 3. Air that has been suctioned with dust through the suction opening of the nozzle 6 by generating the suction force at the suction port 3 passes through the pipe 5 and the hose 4.

As indicated by arrows in FIG. 3, FIG. 6, and FIG. 7, the air that has passed through the pipe 5 and the hose 4 is introduced into the dust collecting chamber 13 through the suction port 3. To the suction port 3, the dust collecting bag 18 is connected. Dust contained in the air is caught and collected by the dust collecting bag 18. The air passes through the dust collecting bag 18. The air that has passed through the dust collecting bag 18 passes through the filter 19. The filter 19 catches and collects fine dust that cannot be caught by the dust collecting bag 18. The air that has passed through the filter 19 passes through the flow path 14, and then flows into the motor chamber 15. The air that has flowed into the motor chamber 15 passes through the fan 31 and the motor 32, comes into contact with the control board 35, and then flows into the flow path 16A. The air that has flowed through the flow path 16A passes through the vents 41 and flows into the flow path 16B. The air that has flowed through the flow path 16B is discharged through the exhaust port 17.

The slit-shaped vents 41 prevent foreign matters from entering the flow path 16A. Air flowing through the vents 41 may generate noise like wind noise. In the present embodiment, the noise-absorbing member 42 is disposed downstream of the vents 41. The noise-absorbing member 42 suppresses generation of such noise.

Figure 9:
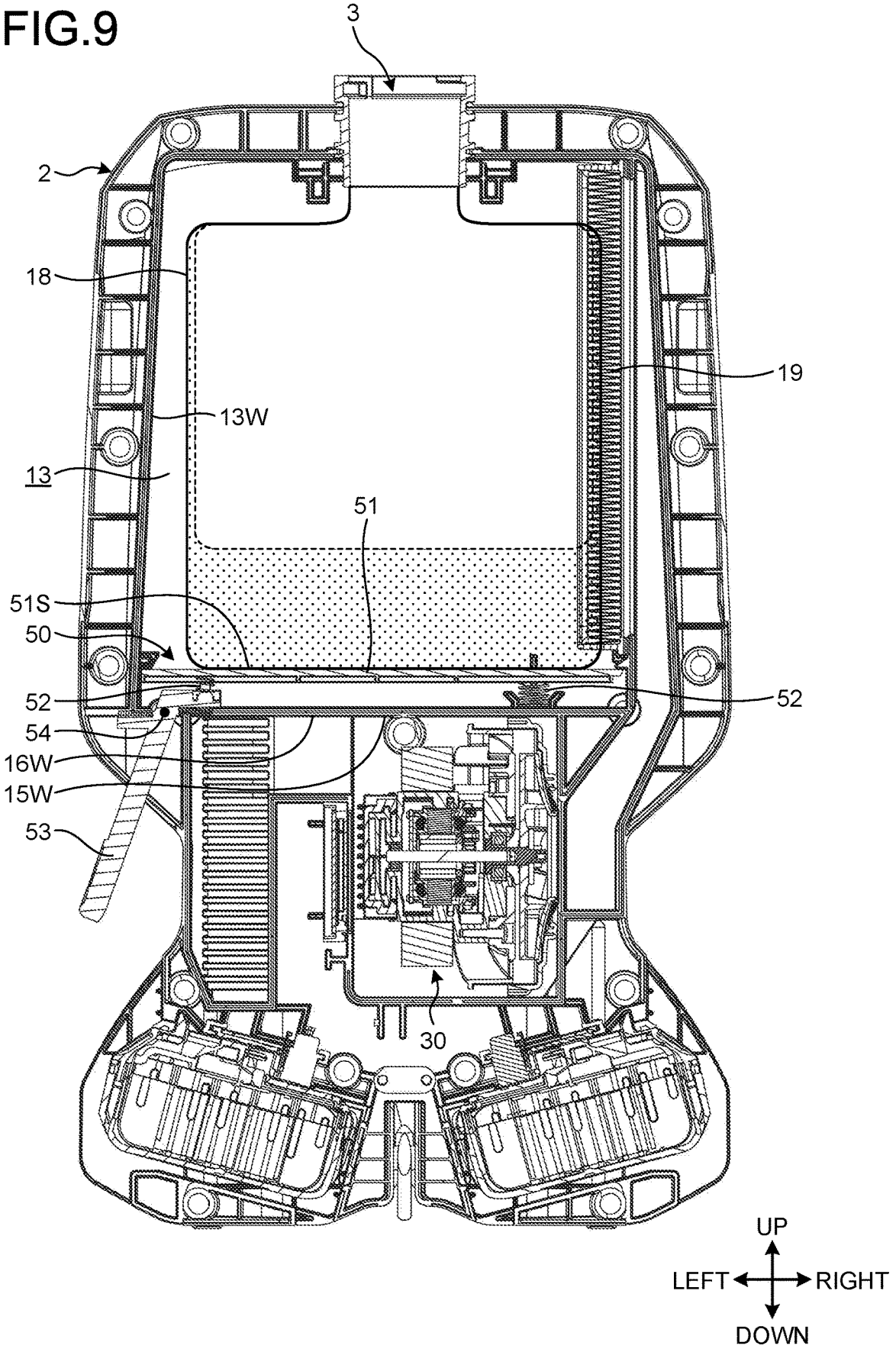
FIG. 9 is a sectional view of a dust collecting bag according to the first embodiment.

FIG. 9 is a sectional view of the dust collecting bag 18 according to the present embodiment. As illustrated in FIG. 9, when dust has been accumulated in the dust collecting bag 18, load due to the weight of the dust is applied to the bottom surface of the dust collecting chamber 13 from the dust collecting bag 18. In the present embodiment, the filter 19 is disposed on a side of the dust collecting chamber 13 so as to face the dust collecting chamber 13 in a state in which the housing 2 is carried on the operator WM's back. In the present embodiment, the filter 19 is disposed on the right side of the dust collecting chamber 13. This prevents the filter 19 from being clogged by the dust collecting bag 18 even when dust has been accumulated in the dust collecting bag 18. Because the filter 19 is prevented from being clogged, reduction of the suction force of the backpack dust collector 1 is suppressed.

The backpack dust collector 1 includes a vibration device 50 configured to vibrate the dust collecting bag 18. As illustrated in FIG. 9, at least part of dust may stick to an upper portion of the inner surface of the dust collecting bag 18. When dust has stuck up to the upper portion of the inner surface of the dust collecting bag 18, the flow rate of air passing through the dust collecting bag 18 decreases, whereby the suction force of the backpack dust collector 1 may be reduced. When the vibration device 50 vibrates the dust collecting bag 18, the dust sticking to the upper portion of the inner surface of the dust collecting bag 18 is shaken off, and piles up in a lower portion of the dust collecting bag 18. Thus, reduction of the suction force of the backpack dust collector 1 is suppressed.

In the present embodiment, the vibration device 50 includes a support member 51 supported by elastic members 52 and having a support surface 51S that can be brought into contact with the dust collecting bag 18.

The support member 51 is a plate-like member. As illustrated in FIG. 9, the support member 51 is disposed below the dust collecting bag 18 in the dust collecting chamber 13. The support surface 51S includes an upper surface of the support member 51 that can be brought into contact with a lower portion of the dust collecting bag 18.

The elastic members 52 are coil springs, for example. The elastic members 52 support a lower surface of the support member 51. In the present embodiment, the elastic members 52 are supported by the partition wall 15W and the partition wall 16W that are disposed below the support member 51. The support member 51 is supported by the partition wall 15W and the partition wall 16W with the elastic members 52 interposed therebetween. The elastic members 52 support the support member 51 in a swingable manner.

The backpack dust collector 1 includes an operating member 53 for moving the support member 51. The operating member 53 is operated by the operator WM. An upper end portion of the operating member 53 is arranged so as to face a lower surface of the support member 51. A lower end portion of the operating member 53 is arranged outside the housing 2. An intermediate portion of the operating member 53 is coupled to at least part of the housing 2 by a hinge 54.

Figure 10:
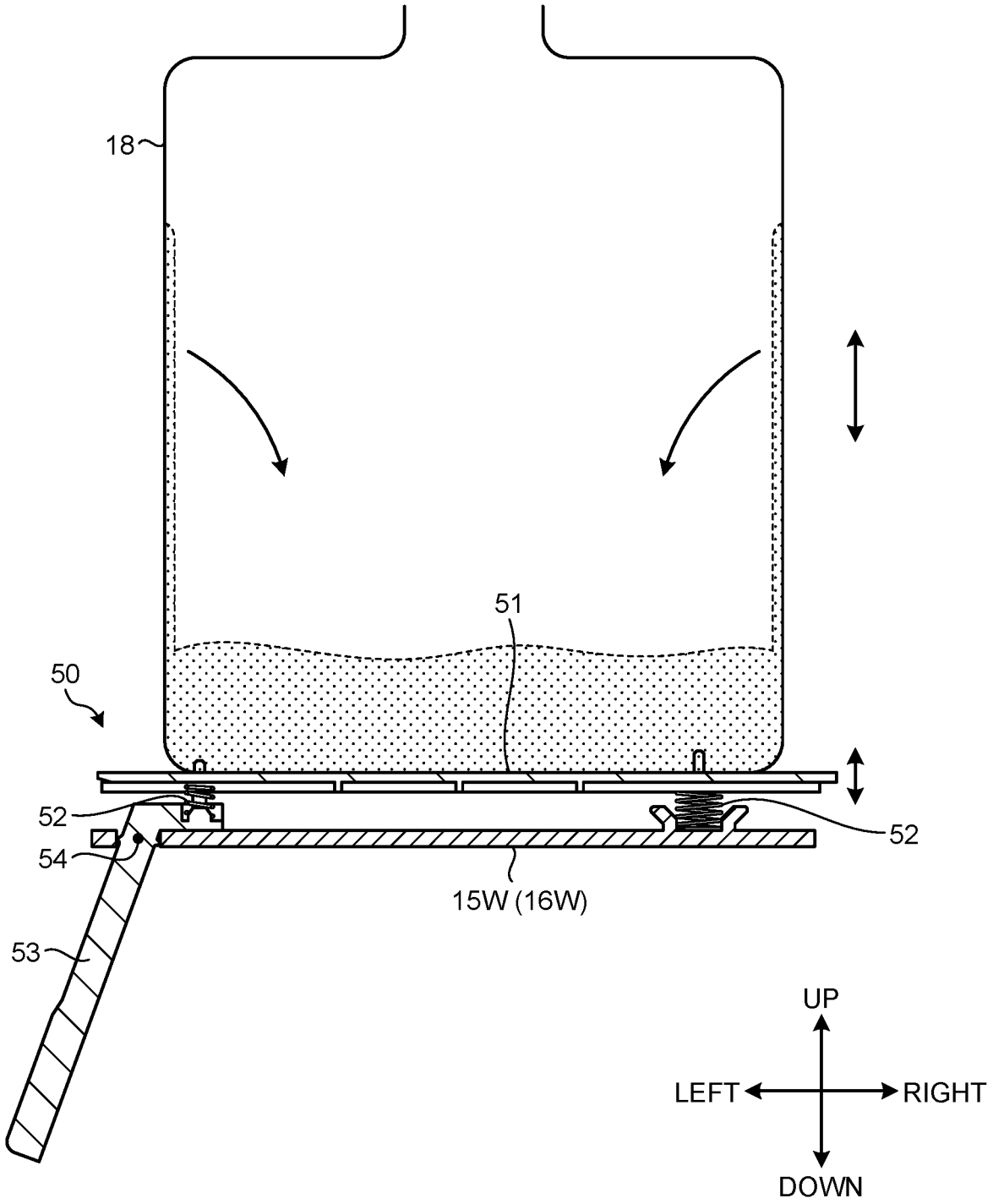
FIG. 10 is a diagram for describing motion of a vibration device according to the first embodiment.

FIG. 10 is a diagram for describing motion of the vibration device 50 according to the present embodiment. When the operator WM moves or walks while carrying the housing 2 on his/her back, the housing 2 moves accordingly. When the housing 2 moves, the support member 51 supported by the elastic members 52 vibrates with an amplitude greater than the amplitude of the housing 2. When the housing 2 moves, vibrations of the housing 2 are transmitted to the support member 51 in an amplified manner due to the effect of the elastic members 52. When the support member 51 vibrates greatly, the dust collecting bag 18 supported by the support member 51 accordingly vibrates greatly. When the dust collecting bag 18 vibrates greatly, dust sticking to an upper portion of the inner surface of the dust collecting bag 18 is shaken off, and piles up in a lower portion of the dust collecting bag 18 as illustrated in FIG. 10. Thus, reduction of the suction force of the backpack dust collector 1 is suppressed.

Figure 11:
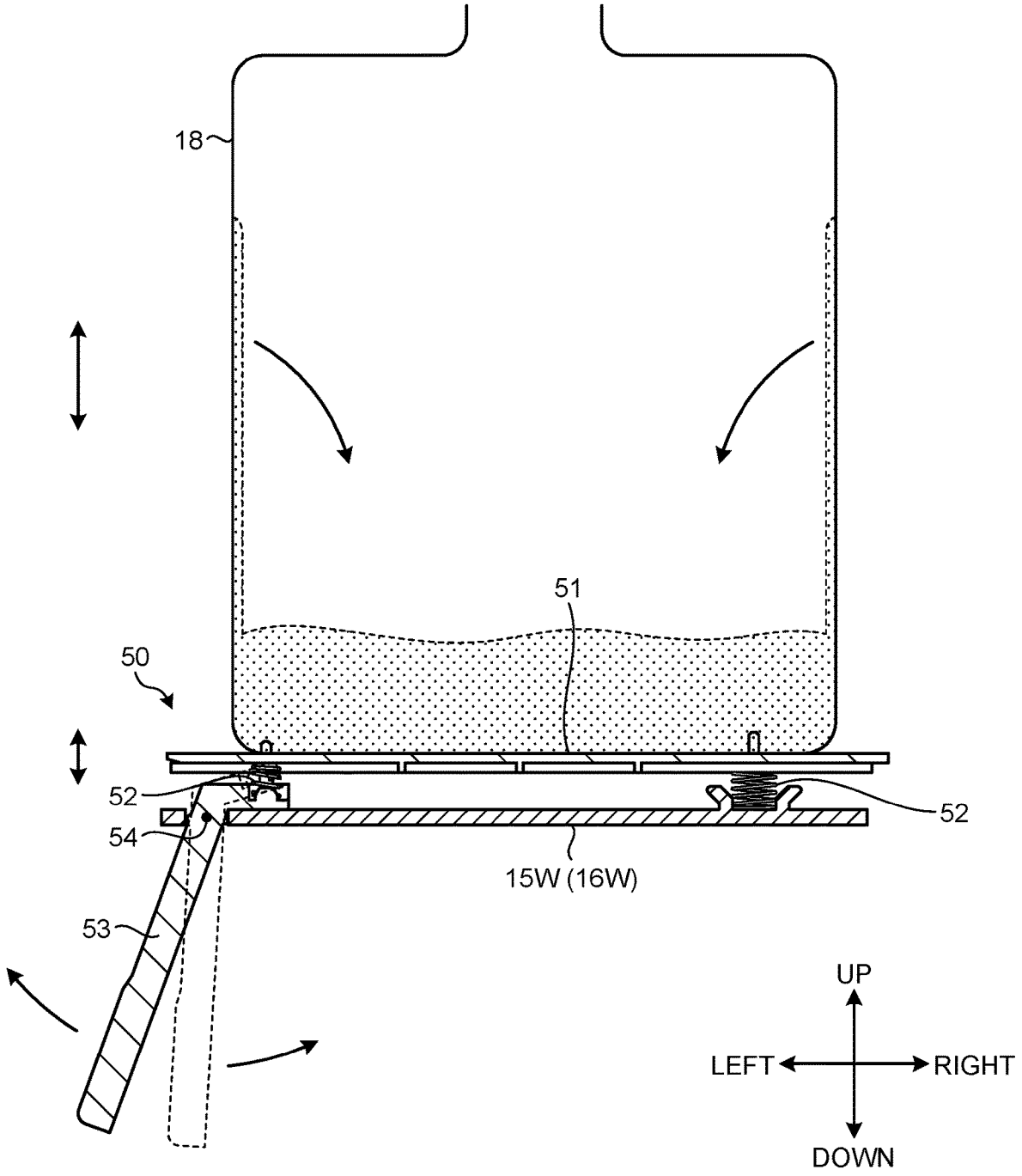
FIG. 11 is a diagram for describing motion of an operating member according to the first embodiment.

FIG. 11 is a diagram for describing motion of the operating member 53 according to the present embodiment. As illustrated in FIG. 11, the operator WM can operate the operating member 53 such that the operating member 53 rotates about the rotation axis of the hinge 54. When the operating member 53 is operated, the upper end portion of the operating member 53 moves up and down while being in contact with the support member 51. Thus, the support member 51 greatly vibrates up and down. When the support member 51 greatly moves up and down, the dust collecting bag 18 supported by the support member 51 accordingly moves greatly. When the dust collecting bag 18 vibrates greatly, dust sticking to an upper portion of the inner surface of the dust collecting bag 18 is shaken off, and piles up in a lower portion of the dust collecting bag 18 as illustrated in FIG. 11. Thus, reduction of the suction force of the backpack dust collector 1 is suppressed.

As illustrated in FIG. 2, FIG. 3, FIG. 5, and FIG. 6, the battery openings 11 are formed each on the left side surface 2E and the right side surface 2F of the housing 2. The battery openings 11 and the battery receiving portions 12 are formed in lower portions of the housing 2.

Each battery mounting portion 8 is arranged on an upper surface of the corresponding battery receiving portion 12. The battery mounting portion 8 has guide rails 81 configured to guide the corresponding battery 7 and a connection terminal 82 configured to be connected to a battery terminal 72 of the battery 7. The guide rails 81 extend in the right-and-left direction. The guide rails 81 in a pair are arranged in the front-and-rear direction. The guide rails 81 in a pair are arranged in parallel. The connection terminal 82 is arranged between the pair of guide rails 81.

The battery 7 is a general-purpose battery. The battery 7 may be a battery for a power tool. In the present embodiment, the battery 7 can be used as a direct-current power supply for a power tool. The battery 7 includes a plurality of lithium ion battery cells. The battery 7 can be charged by a battery charger. The battery 7 is portable. The battery 7 supplies power to at least the motor 32.

The battery 7 has a pair of slide rails 71 to be guided by the guide rails 81, the battery terminal 72 to be connected to the connection terminal 82 of the battery mounting portion 8, and a release button 73.

The slide rails 71 are guided by the guide rails 81 of the battery mounting portion 8. The slide rails 71 in a pair are arranged in parallel. The battery terminal 72 is arranged between the pair of slide rails 71. In a state in which the battery 7 is mounted on the battery mounting portion 8, the battery terminal 72 is connected to the connection terminal 82.

The release button 73 is operated to release the battery 7 fixed to the battery mounting portion 8. The release button 73 is provided on one end surface 7A of the battery 7. The battery 7 is mounted on the battery mounting portion 8 such that the release button 73 is directed outward in the right-and-left direction with respect to the center of the housing 2. In the state in which the battery 7 is mounted on the battery mounting portion 8, the release button 73 faces the battery opening 11.

In the present embodiment, the battery mounting portion 8 is inclined downward in the battery receiving portion 12 as farther from the battery opening 11. In other words, the battery mounting portion 8 is inclined downward toward a deeper position in the battery receiving portion 12. The guide rails 81 are inclined downward in the battery receiving portion 12 as farther from the battery opening 11.

The front housing 21 and the rear housing 22 have respective bottom plates 26 that define bottom surfaces 2P of the battery receiving portion 12. Each of the bottom surfaces 2P faces part of the corresponding lower surface of the battery 7 mounted on the battery mounting portion 8. The bottom surfaces 2P are inclined downward in the battery receiving portion 12 as farther from the battery opening 11. The bottom plate 26 of the front housing 21 is fixed to at least part of the front housing 21 with a rib interposed therebetween. The bottom plate 26 of the rear housing 22 is fixed to at least part of the rear housing 22 with a rib interposed therebetween. In a lower portion of the battery receiving portion 12, an opening 12K is disposed. The opening 12K is disposed between the bottom plate 26 of the front housing 21 and the bottom plate 26 of the rear housing 22.

The front housing 21 and the rear housing 22 have respective inner side plates 27 that define inner side surfaces 2Q connected to the battery opening 11. Each inner side surfaces 2Q faces part of the corresponding side surface of the battery 7 passing through the battery opening 11. The inner side surfaces 2Q of the front housing 21 are inclined rearward in the battery receiving portion 12 as farther from the battery opening 11. The inner side surfaces 2Q of the rear housing 22 are inclined forward in the battery receiving portion 12 as farther from the battery opening 11. In other words, the width of a passage in the front-and-rear direction through which the battery 7 passes in the battery receiving portion 12 is smaller in the battery receiving portion 12 as farther from the battery opening 11.

Figure 12:
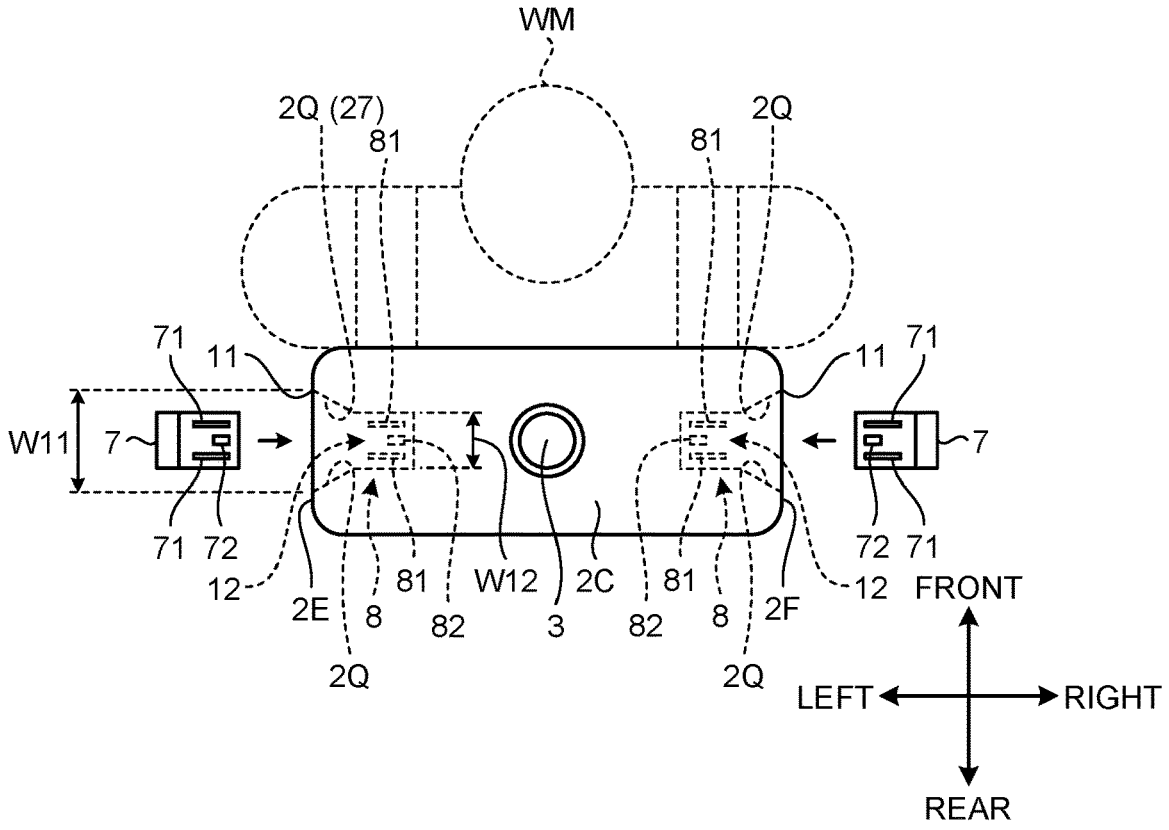
FIG. 12 is a top view schematically illustrating motion when batteries according to the first embodiment are mounted on battery mounting portions.

FIG. 12 is a top view schematically illustrating motion when the batteries 7 according to the present embodiment are mounted on the battery mounting portions 8. When mounting the batteries 7 on the battery mounting portions 8, the operator WM inserts the batteries 7 into the battery receiving portions 12 disposed in the left side surface 2E and the right side surface 2F through the respective battery openings 11, thereby being able to mount the batteries 7 on the battery mounting portions 8.

When mounting a battery 7 on the left battery mounting portion 8, the operator WM inserts the battery 7 into the battery opening 11 disposed at the left side surface 2E. The operator WM slides the battery 7 rightward while causing the guide rails 81 of the battery mounting portion 8 to guide the slide rails 71 of the battery 7. When the battery 7 has been slid rightward, the battery 7 is fixed to the battery mounting portion 8, and the battery terminal 72 of the battery 7 is connected to the connection terminal 82 of the battery mounting portion 8. Thus, the battery 7 is mounted on the battery mounting portion 8.

When mounting a battery 7 on the right battery mounting portion 8, the operator WM inserts the battery 7 into the battery opening 11 formed at the right side surface 2F, and then slides the battery leftward, thereby being able to mount the battery 7 on the battery mounting portion 8.

As illustrated in FIG. 2 and FIG. 12, in the present embodiment, the dimension W11 of each battery opening 11 in the front-and-rear direction is larger than the dimension W12 of the corresponding battery receiving portion 12 in the front-and-rear direction where the corresponding guide rails 81 are arranged. The dimension W11 corresponds to the distance between end portions of the pair of inner side surfaces 2Q that are closest to the battery opening 11. The dimension W12 corresponds to the distance between end portions of the pair of inner side surfaces 2Q that are closest to the guide rails 81. Because the dimension W11 of the battery opening 11 is large, the operator WM can insert the corresponding battery 7 smoothly into the battery opening 11. The operator WM can insert the battery 7 into the battery opening 11 while holding, for example, side surfaces of the battery 7. Because the dimension W12 of the battery receiving portion 12 is small, the battery 7 can be moved in the battery receiving portion 12 while being guided by the inner side surfaces of the battery receiving portion 12 that are located deeper than the corresponding inner side plates 27 and also by the guide rails 81 in the battery receiving portion 12.

Furthermore, because the corresponding bottom plate 26 is provided, the battery 7 can be prevented from falling from the battery receiving portion 12 when the battery 7 is mounted on the battery mounting portion 8 or when the battery 7 is pulled out of the battery mounting portion 8.

As illustrated in FIG. 3 and FIG. 6, the backpack dust collector 1 includes moving mechanisms 74 each disposed in the corresponding battery receiving portion 12 and configured to generate force for moving the corresponding battery 7 toward the corresponding battery opening 11. Each moving mechanism 74 is disposed at a position where it can be in contact with the corresponding battery 7.

The moving mechanism 74 includes an elastic member 74E. Examples of the elastic member 74E include a leaf spring. The elastic member 74E may include a coil spring.

The elastic member 74E is disposed so as to face the other end surface 7B of the battery 7 in a state in which the battery 7 is mounted on the battery mounting portion 8. The elastic member 74E is disposed on the opposed surface 12A of the battery receiving portion 12. In the state in which the battery 7 is mounted on the battery mounting portion 8, the other end surface 7B of the battery 7 faces the opposed surface 12A. In the state in which the battery 7 is mounted on the battery mounting portion 8, the other end surface 7B of the battery 7 is in contact with the elastic member 74E.

Figure 13:
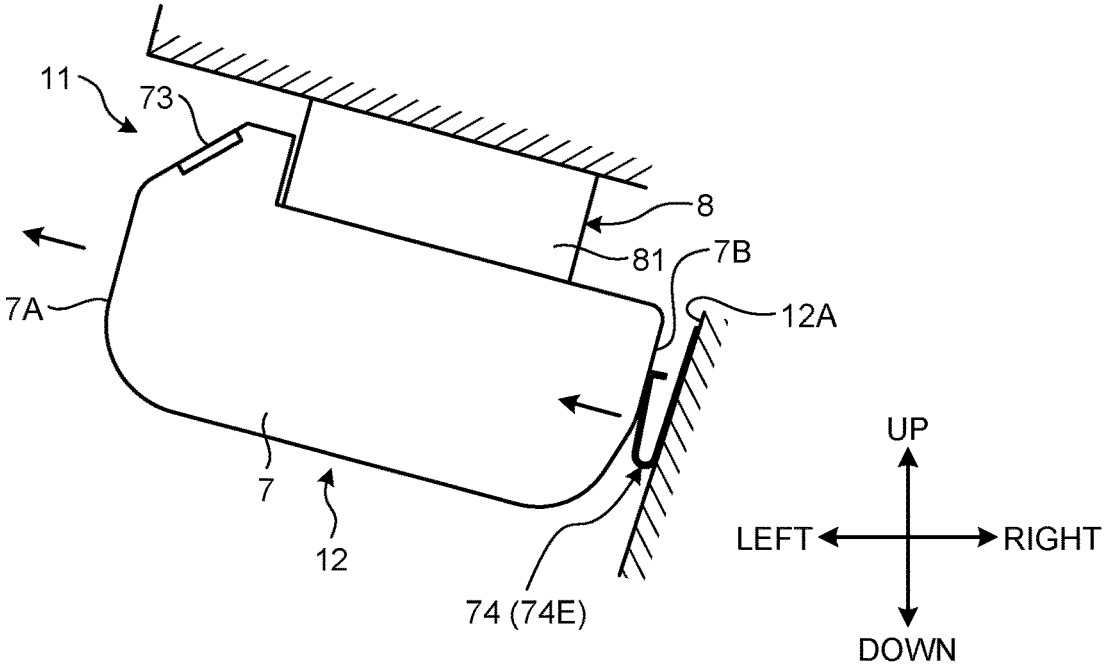
FIG. 13 is a diagram schematically illustrating a state in which a battery according to the first embodiment is mounted on a battery mounting portion.

FIG. 13 is a diagram schematically illustrating a state in which a battery 7 according to the present embodiment is mounted on a battery mounting portion 8. The guide rails 81 of the battery mounting portion 8 are inclined downward in the corresponding battery receiving portion 12 as farther from the corresponding battery opening 11. In the state in which the battery 7 is mounted on the battery mounting portion 8, the other end surface 7B of the battery 7 is in contact with the corresponding elastic member 74E. In the state in which the battery 7 is mounted on the battery mounting portion 8, the elastic member 74E is elastically deformed by the battery 7. The elastic member 74E thus elastically deformed generates elastic force for moving the battery 7 toward the battery opening 11.

When removing the battery 7 from the battery mounting portion 8, the operator WM operates the corresponding release button 73. When the release button 73 has been operated, the battery 7 fixed to the battery mounting portion 8 is released. When the battery 7 fixed to the battery mounting portion 8 has been released, the battery 7 is moved toward the battery opening 11 by the elastic force generated by the elastic member 74E. By the elastic force generated by the elastic member 74E, at least part of the battery 7 including the one end surface 7A is ejected outside the battery receiving portion 12 through the battery opening 11. This allows the operator WM to hold the battery 7 smoothly. While holding the battery 7 pulled out of the battery mounting portion 8, the operator WM can remove the battery from the battery receiving portion 12.

As described in the foregoing, according to the present embodiment, the filter 19 is disposed on a side of the dust collecting chamber 13 so as to face the dust collecting chamber 13. This prevents the filter 19 from being clogged by the dust collecting bag 18. Thus, reduction of the suction force of the backpack dust collector 1 is suppressed. For example, even when dust is accumulated in the dust collecting bag 18, the filter 19 is prevented from being clogged by the dust collecting bag 18.

The motor chamber 15 is disposed below the dust collecting chamber 13. The fan 31 is disposed such that the rotation axis AX of the fan 31 is orthogonal to the up-and-down direction. Thus, air that has discharged from the dust collecting chamber 13 and has flowed through the filter 19 and the flow path 14 can flow through the motor chamber 15 in a direction orthogonal to the up-and-down direction.

The control board 35 is disposed downstream of the motor 32 such that the surface of the control board 35 is orthogonal to the rotation axis AX. This allows air from the fan 31 to blow against the control board 35 sufficiently. Thus, the control board 35 is effectively cooled.

The suction port 3 is disposed in an upper portion of the housing 2. This enables dust suctioned from the suction port 3 to move to a lower portion of the dust collecting bag 18 by the action of gravity. Dust is prevented from sticking to an upper portion of the inner surface of the dust collecting bag 18.

The vibration device 50 configured to vibrate the dust collecting bag 10 is provided. This enables dust to be shaken off even if the dust has stuck to the inner surface of the dust collecting bag 18. Because the dust is shaken off from the inner surface of the dust collecting bag 18, reduction of the suction force of the backpack dust collector 1 is suppressed.

The vibration device 50 includes the support member 51 supported by the elastic members 52 and having the support surface 51S capable of being brought into contact with the dust collecting bag 18. Thus, the operator WM can vibrate the dust collecting bag 18 by moving or walking while carrying the backpack dust collector 1 on his/her back.

The support member 51 is disposed below the dust collecting bag 18 in the dust collecting chamber 13. This allows the dust collecting bag 18 to be shaken from below, and thus dust sticking to the inner surface of the dust collecting bag 18 is effectively shaken off.

The operating member 53 for moving the support member 51 is provided. This enables the operator WM to vibrate the dust collecting bag 18 at any timing.

Second Embodiment

In the following description, components that are the same as or equivalent to those in the above-described embodiment are designated by the same signs, and description thereof is simplified or omitted.

Figure 14:
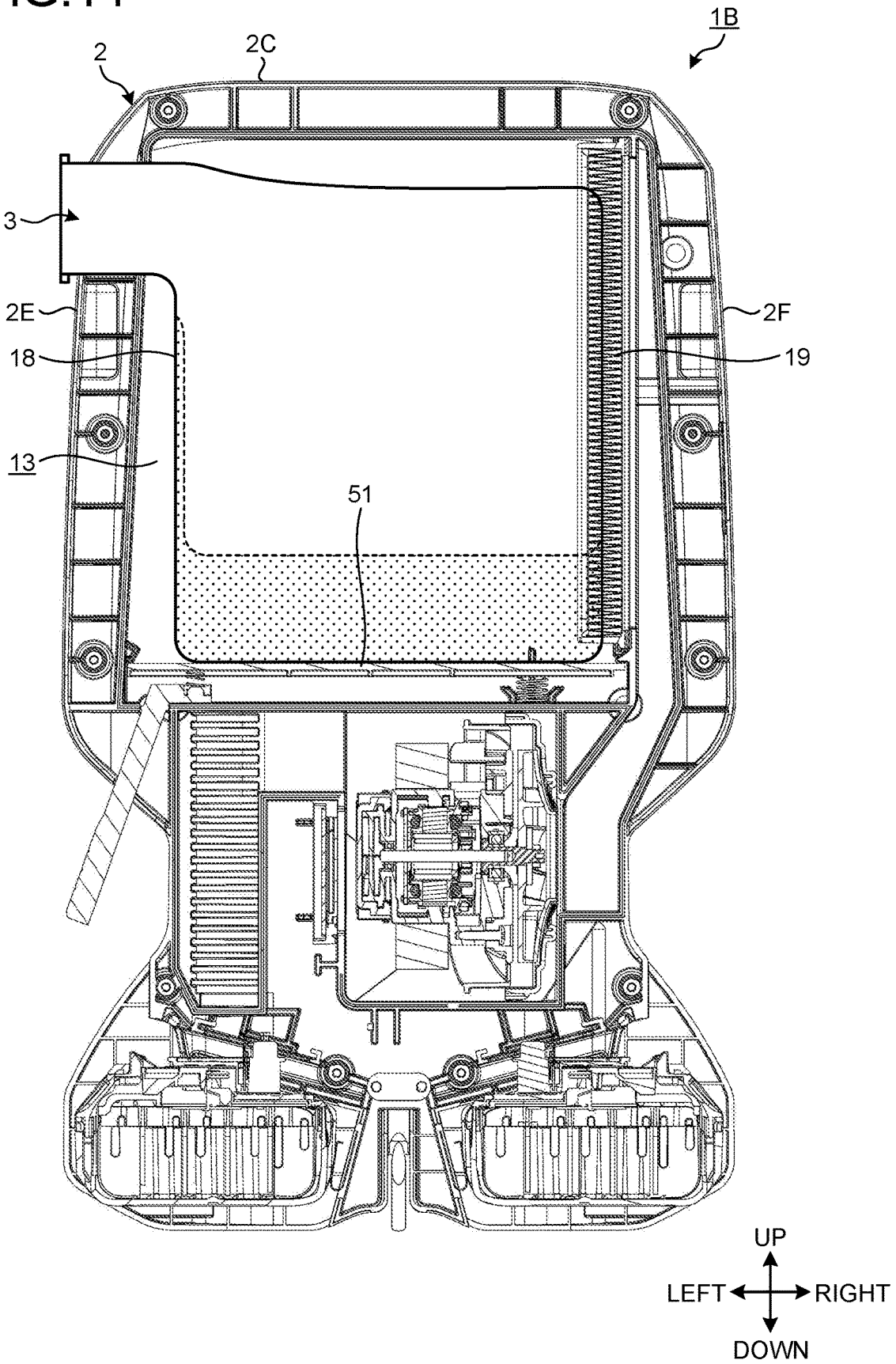
FIG. 14 is a sectional view of a backpack dust collector according to a second embodiment.

FIG. 14 is a sectional view of a backpack dust collector 1B according to the present embodiment. In the above-described embodiment, the suction port 3 is disposed on the upper surface 2C of the housing 2. As illustrated in FIG. 14, the suction port 3 may be disposed on the left side surface 2E of the housing 2. Alternatively, the suction port 3 may be disposed on the right side surface 2F of the housing 2.

Third Embodiment

Figure 15:
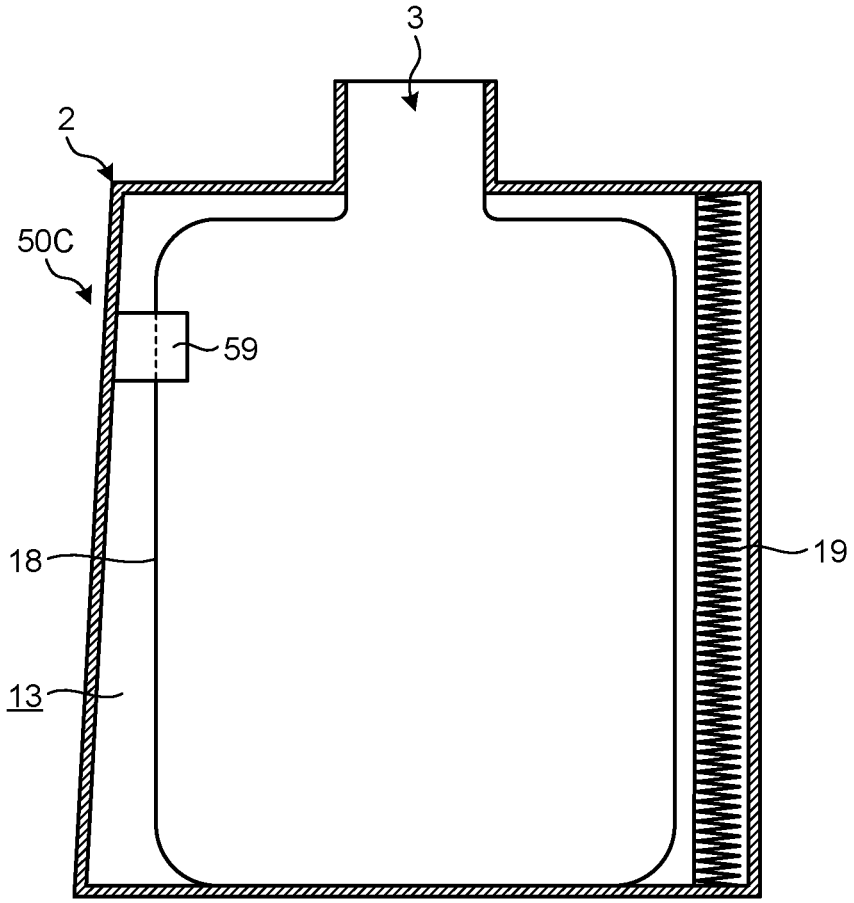
FIG. 15 is a diagram schematically illustrating a vibration device according to a third embodiment.

FIG. 15 is a diagram schematically illustrating a vibration device 50C according to the present embodiment. As illustrated in FIG. 15, the vibration device 50C includes a vibrating element 59 connected to an upper portion of the dust collecting bag 18. The vibrating element 59 is disposed in the dust collecting chamber 13. The vibrating element 59 can impart vibrations to the upper portion of the dust collecting bag 18. When the vibrating element 59 is driven, dust sticking to an upper portion of the inner surface of the dust collecting bag 18 is effectively shaken off.

Fourth Embodiment

Figure 16:
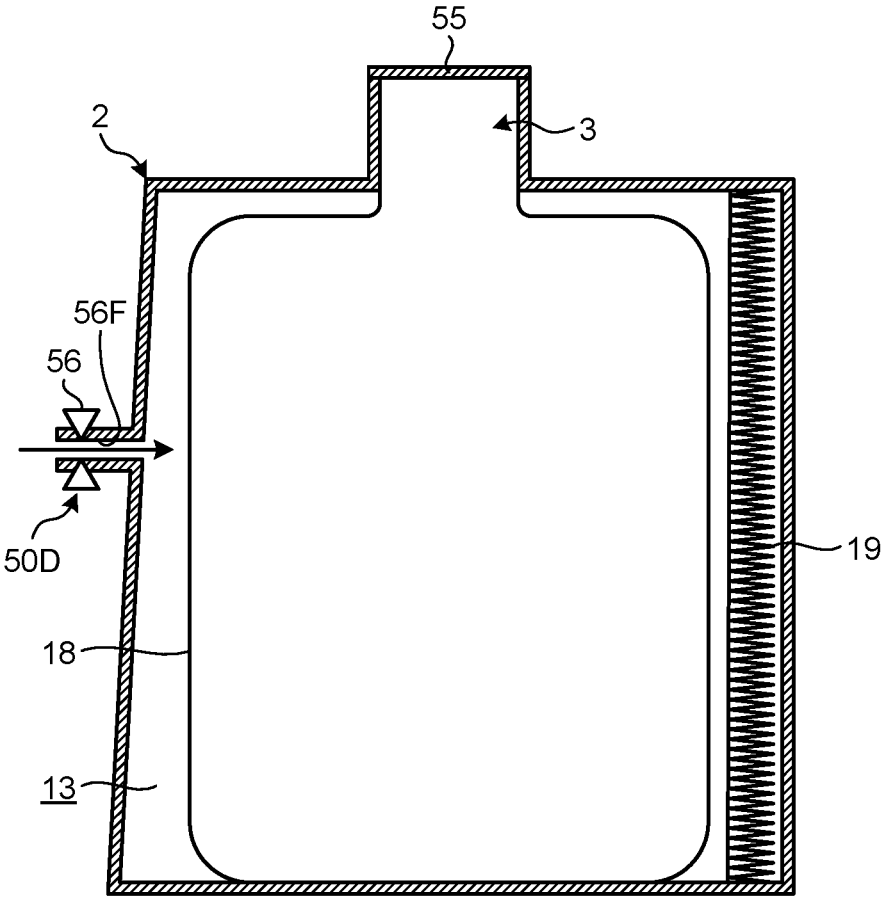
FIG. 16 is a diagram schematically illustrating a vibration device according to a fourth embodiment.

FIG. 16 is a diagram schematically illustrating a vibration device 50D according to the present embodiment. The vibration device 50D includes a flow path 56F connecting the dust collecting chamber 13 and a space outside the housing 2 and a valve 56 configured to open and close the flow path 56F. The flow path 56F is disposed at a position different from that of the suction port 3. When the dust collecting bag 18 is vibrated, the motor 32 is driven with the suction port 3 being closed by a lid 55 and with the flow path 56F being closed by the valve 56. This causes pressure in the dust collecting chamber 13 to decrease. After the pressure in the dust collecting chamber 13 has decreased, the valve 56 is operated to open the flow path 56F. When the flow path 56F has been opened in a state in which the pressure in the dust collecting chamber 13 had decreased, air in a space outside the housing 2 flows into the dust collecting chamber 13 through the flow path 56F. The air in a space outside housing 2 flows into the dust collecting chamber 13 at high velocity. By the air flowing into the dust collecting chamber 13, the dust collecting bag 18 is vibrated. In the present embodiment, too, dust sticking to the inner surface of the dust collecting bag 18 is shaken off.

Fifth Embodiment

Figure 17:
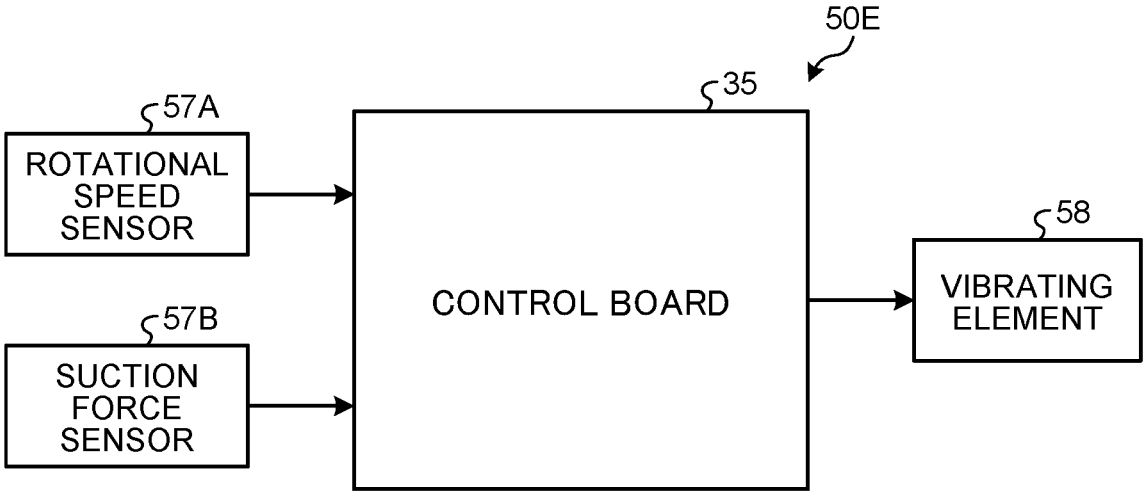
FIG. 17 is a block diagram illustrating a vibration device according to a fifth embodiment.

FIG. 17 is a block diagram illustrating a vibration device 50E according to the present embodiment. As illustrated in FIG. 17, the vibration device 50E includes the control board 35, a rotational speed sensor 57A configured to detect the number of revolutions of the motor 32, a suction force sensor 57B configured to detect suction force at the suction port 3, and a vibrating element 58 disposed so as to be in contact with the dust collecting bag 18.

The control board 35 causes the vibrating element 58 to be driven based on detection data of the rotational speed sensor 57A. For example, when it is determined that the motor 32 has stopped being driven and the number of revolutions of the motor 32 has reached a first threshold or smaller, the control board 35 starts up the vibrating element 58. The first threshold is a predetermined value. When the number of revolutions of the motor 32 has decreased, the vibrating element 58 vibrates the dust collecting bag 18, thereby effectively shaking off dust sticking to the inner surface of the dust collecting bag 18.

The control board 35 may cause the vibrating element 58 to be driven based on detection data of the suction force sensor 57B. For example, when it is determined that the motor 32 has stopped being driven and the suction force has reached a second threshold or smaller, the control board 35 starts up the vibrating element 58. The second threshold is a predetermined value. When the suction force has decreased, the vibrating element 58 vibrates the dust collecting bag 18, thereby effectively shaking off dust sticking to the inner surface of the dust collecting bag 18.

According to an aspect of the present invention, reduction of the suction force can be suppressed.

What is claimed is:

1. A backpack dust collector comprising:

a housing including:

a suction port, a dust collecting chamber (1) connected to the suction port, (2) having a vertical height in an up-down direction when the backpack dust collector is carried on a back of a user, (3) having a vertical center axis in the up-down direction that is a longitudinal axis at a center of the dust collecting chamber, and (4) accommodating a dust collecting bag, a motor chamber connected to the dust collecting chamber and accommodating a fan and a motor, and an exhaust port through which air from the motor chamber is discharged; and a filter, wherein:

the dust collecting chamber, the motor chamber, the fan, the motor and the filter are configured such that air flows in a flow path from the dust collecting chamber along the vertical height of the dust collecting chamber through the filter along the vertical height of the dust collecting chamber and then down to the motor chamber;

an entirety of the filter is on one side of the vertical center axis, offset from the vertical center axis, and extends concurrently with the dust collecting chamber in the up-down direction; and the motor chamber is directly below the dust collecting chamber in the up-down direction such that the vertical center axis of the dust collecting chamber intersects the motor chamber.

2. The backpack dust collector according to claim 1, wherein a rotation axis of the fan is orthogonal to the up-down direction.

3. The backpack dust collector according to claim 2, further comprising a control board in the motor chamber, wherein the control board is downstream of the motor such that a surface of the control board is orthogonal to the rotation axis.

4. The backpack dust collector according to claim 1, wherein the flow path extends in the up-down direction so as to connect a right portion of the dust collecting chamber that is offset from the vertical center axis and a right portion of the motor chamber that is offset from the vertical center axis.

5. The backpack dust collector according to claim 1, wherein the suction port is in an upper portion of the housing.

6. The backpack dust collector according to claim 5, wherein the dust collecting bag is connected to the suction port, and the backpack dust collector further comprises a support member below the dust collecting bag in the dust collecting chamber and capable of being brought into contact with a lower portion of the dust collecting bag.

7. The backpack dust collector according to claim 1, further comprising a vibration device configured to vibrate the dust collecting bag.

8. The backpack dust collector according to claim 7, wherein the vibration device includes:

a support member below the dust collecting bag in the dust collecting chamber and configured to be brought into contact with a lower portion of the dust collecting bag; and an elastic member supporting a lower surface of the support member and configured such that the support member vibrates in response to elastic deformation of the elastic member in the up-down direction.

9. A backpack dust collector comprising:

a housing including:

a suction port, a dust collecting chamber connected to the suction port and accommodating a dust collecting bag, a motor chamber connected to the dust collecting chamber and accommodating a fan and a motor, and an exhaust port through which air from the motor chamber is discharged; and a vibration device configured to vibrate the dust collecting bag, the vibration device including:

a support member (1) directly below the dust collecting bag in an up-down direction in the dust collecting chamber when the backpack dust collector is carried on a back of a user such that at least one line in the up-down direction intersects both the dust collecting chamber and the motor chamber and (2) configured to be brought into contact with a lower portion of the dust collecting bag; and an elastic member (i) entirely below and (ii) engaging and supporting a lower surface of the support member, wherein the elastic member is between the lower surface and the housing in the up-down direction; and the support member and the elastic member are configured such that the elastic member exerts a biasing force directly on the lower surface pushing the support member upward against the dust collecting bag and the support member vibrates in response to elastic deformation of the elastic member in the up-down direction.

10. The backpack dust collector according to claim 9, wherein the support member is a plate-like member, and an upper surface of the support member is configured to be brought into contact with the lower portion of the dust collecting bag.

11. The backpack dust collector according to claim 10, wherein the housing includes a partition wall below the support member, the elastic member is supported by the partition wall, and the support member is supported by the partition wall with the elastic member therebetween.

12. The backpack dust collector according to claim 9, further comprising an operating member to move the support member.

13. The backpack dust collector according to claim 12, wherein an upper end portion of the operating member faces a lower surface of the support member, a lower end portion of the operating member is outside the housing, and an intermediate portion of the operating member is coupled to the housing by a hinge.

14. The backpack dust collector according to claim 9, wherein the vibration device includes a vibrating element connected to the dust collecting bag and configured to impart vibration to the dust collecting bag.

15. The backpack dust collector according to claim 9, wherein the vibration device includes:

a flow path connecting the dust collecting chamber and a space outside the housing; and a valve to open and close the flow path, and after the motor is driven with the flow path being closed by the valve, the flow path is opened by the valve.

16. The backpack dust collector according to claim 9, wherein the vibration device includes:

a rotational speed sensor configured to detect the number of revolutions of the motor; and a vibrating element configured to vibrate the dust collecting bag when it is determined that the number of revolutions of the motor has reached a first threshold or smaller, based on detection data of the rotational speed sensor.

17. The backpack dust collector according to claim 9, wherein the vibration device includes:

a suction force sensor configured to detect suction force at the suction port; and a vibrating element configured to vibrate the dust collecting bag when it is determined that the suction force has reached a second threshold or smaller, based on detection data of the suction force sensor.

18. The backpack dust collector according to claim 9, wherein the vibration device and the housing are configured such that the elastic deformation occurs when the user moves while carrying the backpack dust collector on the back of the user.

19. The backpack dust collector according to claim 9, wherein the support member, the elastic member and the dust collecting bag are configured such that the elastic member amplifies any vibration of the backpack dust collector due to movement of the user.

* * * * *